US005232368A

United States Patent [19]

Morgia

[11] Patent Number: 5,232,368

[45] Date of Patent: Aug. 3, 1993

[54] MARTIAL ARTS TRAINING APPROACH BOX

[76] Inventor: Michael Morgia, 376 Brainard St., Watertown, N.Y. 13601

[21] Appl. No.: 966,503

[22] Filed: Oct. 26, 1992

[51] Int. Cl.[5] ..... A63B 69/34

[52] U.S. Cl. ..... 434/247; 482/83; 482/88; 273/DIG. 30

[58] Field of Search ..... 482/85-90, 482/904, 83; 273/DIG. 30, 55 A, 55 R; 434/247

[56] References Cited

U.S. PATENT DOCUMENTS

| | | | |
|---|---|---|---|
| 2,526,217 | 10/1950 | Gilman | 273/55 R |
| 4,295,646 | 10/1981 | Squire . | |
| 4,546,966 | 10/1985 | Segura | 482/88 |
| 4,572,504 | 2/1986 | DiBartolo . | |
| 4,591,148 | 3/1986 | Slater | 482/140 |
| 4,662,630 | 5/1987 | Dignard et al. | 482/87 X |
| 4,667,954 | 5/1987 | McCorkle | 482/86 |
| 4,732,378 | 3/1988 | LeFebvre et al. | 482/88 |
| 4,757,989 | 7/1988 | Bauer . | |
| 4,913,419 | 3/1990 | McAuliffe | 482/87 |
| 4,946,159 | 8/1990 | Jones | 273/55 A X |

*Primary Examiner*—Gene Mancene
*Assistant Examiner*—L. Thomas
*Attorney, Agent, or Firm*—Katherine McGuire

[57] ABSTRACT

A martial arts training focus box comprising a resilient strike board with pile fabric material affixed to the side edges and a perimeter portion of the front surface thereof. Four wedge-shaped strike guide elements having hook fabric material affixed to the base portions thereof removably attach in a variety of positions to the pile fabric material on the strike board to define a strike zone area. The martial arts trainee practices his/her kicking and punching technique by impacting the strike zone. If the technique is poor, one or more of the guide elements will likely be struck and detach from the strike board giving immediate visual indication of the incorrect technique.

17 Claims, 3 Drawing Sheets

MARTIAL ARTS TRAINING APPROACH BOX

BACKGROUND OF THE INVENTION

The present invention relates to martial arts training devices and, more particularly, to a novel and improved striking target which teaches, by means of visual indication, the correct angle of approach, i.e., kick or punch.

Martial artists have used various pads and shields to practice kicking and punching techniques. Typically, these pads are composed of relatively thick slabs of dense, resilient foam rubber and are held by a second person for practice by the trainee. The pads provide a safe way of practicing kicking and punching, but they do not give their users any indication of whether they are using anatomically proper kicking and/or punching form. Even though the user may strike this pad directly in the center, the user's approach to the target and/or his form may be entirely incorrect. It is unbeknownst to the user of the pads whether or not they are using proper form, and therefore they may continue using improper form and develop bad technique.

To provide a way of teaching proper striking technique, martial artists often break boards. In order to break a board, it must be struck properly, therefore serving as a useful training aid to teach proper technique. Due to the hardness of the boards, the chance of injury is great should the board be incorrectly positioned or improperly struck by the student. Examples of board holding devices are disclosed in U.S. Pat. Nos. 4,757,989 to Bauer, Jr., issued Jul. 19, 1988; 4,295,646 to Squire, issued Oct. 20, 1981; and 4,572,504 to DiBartolo, issued Feb. 25, 1986. The major drawbacks to breaking boards, as compared to striking a resilient foam rubber pad, is the expense of the boards which must be replaced upon breakage, as well as the high probability of serious injury if the board is struck improperly.

It is therefore a primary object of the present invention to provide a martial arts training device which safely teaches the user, by means of visual indication, how to strike with proper technique.

It is another object of the present invention to provide a martial arts training apparatus which may be used by martial artists of various skill levels.

It is a further object of the present invention to provide a martial arts training device which gives immediate visual indication of improper approach technique.

It is yet another object of the present invention to provide a martial arts training device which is durable, simple in design and construction, inexpensive to manufacture and which is otherwise economically attractive.

Other objects will in part be obvious and in part appear hereinafter.

SUMMARY OF THE INVENTION

In accordance with the foregoing objects, the invention comprises a martial arts training device comprising a generally rectangular strike board formed of dense and resilient foam rubber material. A plurality of strike guide elements formed in the shape of a wedge are provided to removably attach to the perimeter of the front surface of the kick board by means of pile and hook fabric affixed to facing surfaces of the guide elements and strike board, respectively. The guide elements are arranged about the perimeter of the strike board to define a focus area upon the strike board whereupon the trainee impacts the board during a practice kick or punch. A correct approach is substantially perpendicular to the focus area. If the trainee executes an incorrect kick or punch, the guide elements surrounding the focus area will likely be stricken and detach from the strike board giving immediate visual indication of the incorrect approach. Thereafter, the guide elements may be re-attached to the strike board for repeated kicks and punches.

DETAILED DESCRIPTION

Figure 1:
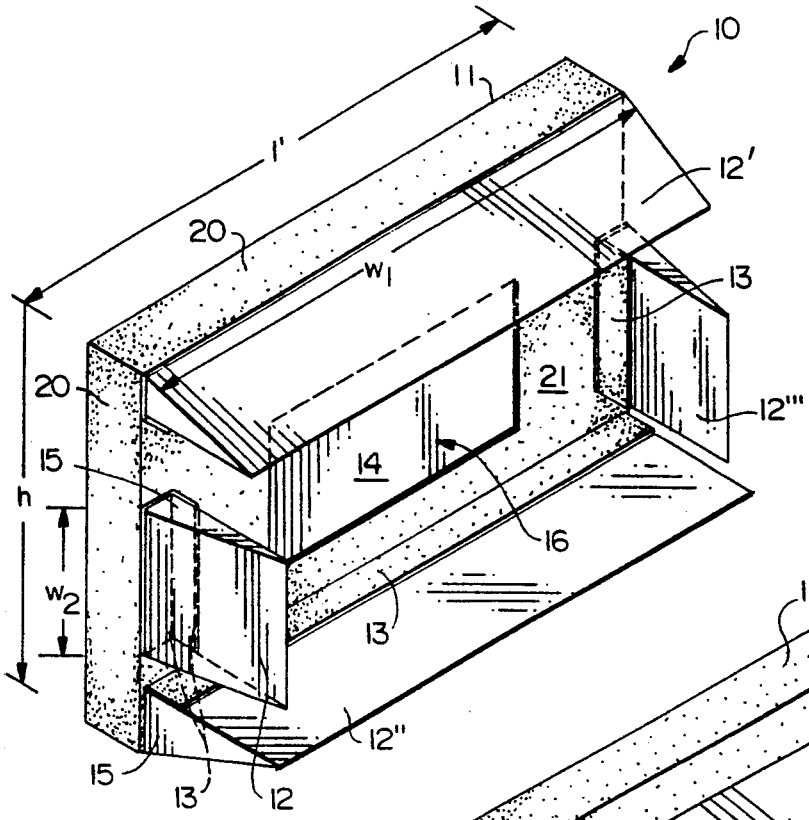
FIG. 1 is a front perspective view of a first embodiment of the present invention showing the strike guide elements in a first attached position.

Referring now to the drawings wherein like reference numerals reference like parts throughout the ensuing specification, there is seen in FIG. 1 a martial arts training device or "focus box" denoted generally by the reference numeral 10. Briefly, focus box 10 comprises a strike board Il and four wedge-shaped, strike guide elements 12, 12', 12'' and 12''' removably secured thereto. Strike guide elements 12, 12', 12'' and 12''' form a boundary on the front surface 14 of strike board 11 which will be termed the strike zone 16 of strike board 11. Focus box 10 provides a martial arts training apparatus which teaches correct target approach technique with strike zone 16 indicating proper placement of the kick or punch upon the target.

A correct approach is substantially in the center and perpendicular to the strike zone 16. Incorrect approaches either entirely miss zone 16, or are placed at an angle other than "straight on" or perpendicular thereto. In this regard, the strike guide elements 12, 12', 12'' and 12''' easily detach from board 11 by means to be described so that they fall away from board 11 should the trainee misplace their approach and strike one or more guide elements. This provides immediate visual indication to the trainee that their approach was off-center. Thereafter, the guide elements may be re-attached to board 11 for repeated training approaches.

More particularly, strike board comprises a somewhat thick, rectangular slab of durable, resilient material, such as a very dense foam rubber. Board 11 includes a substantially planar front surface 14, rear surface 18 (FIG. 4), and sidewalls 20 extending perpendicularly between front surface 14 and rear surface 18. Sidewalls 20 and at least a portion of the periphery of front surface 14 are covered with VELCRO® pile fabric 21 which may be glued or otherwise affixed in covering relation thereto.

The strike guide elements 12–12''' are preferably formed from the same resilient, dense foam as board 11 and are seen to be wedge-shaped including VELCRO® hook fabric swatches 13 affixed in covering relation to the base 15 and extending partially up one side of each element 12, 12', 12'' and 12'''. It will be noticed that two strike guide elements 12' and 12'' are elongated having widths $w_1$ substantially equal to the length 1' of board 11. Conversely, guide elements 12 and 12''' have widths $w_2$ approximately half the height h of board 11.

Figure 2:
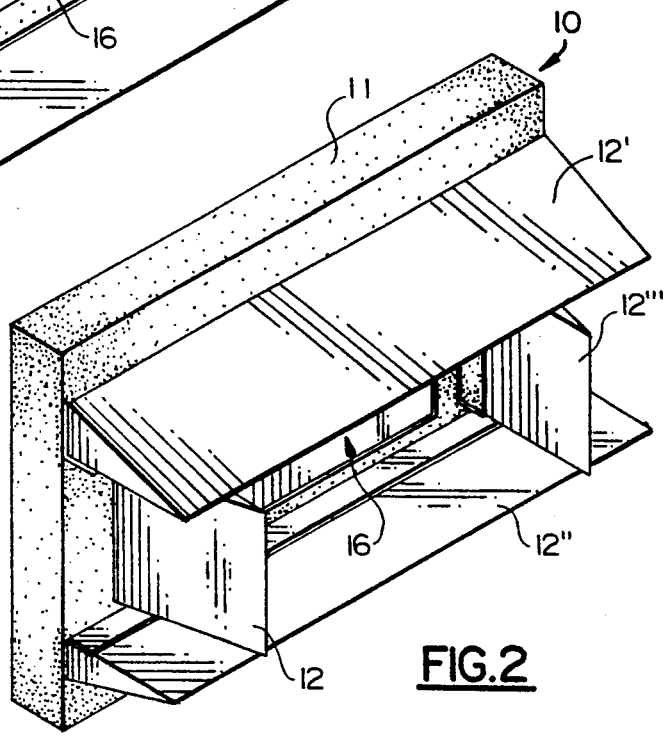
FIG. 2 is the view of FIG. 1 showing the strike guide elements in a second attached position.
Figure 3:
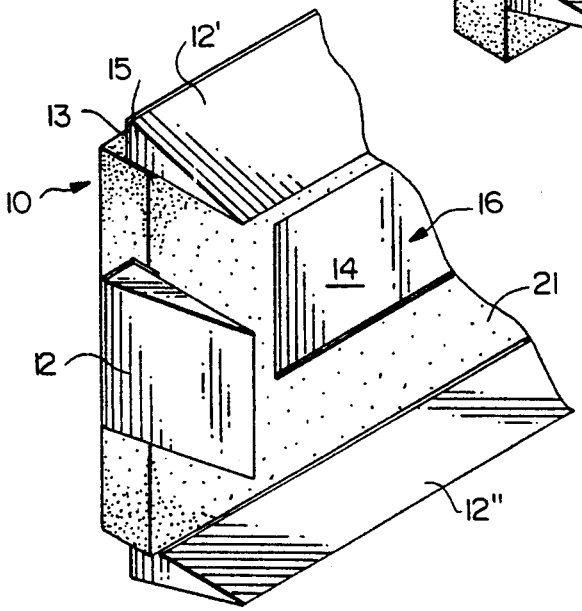
FIG. 3 is a broken away perspective view showing the left hand portion of the embodiment shown in FIGS. 1 and 2 showing the strike guide elements in yet a third attached position.

As seen in FIGS. 1 and 2, guide elements 12, 12', 12'' and 12''' are removably positioned on the front surface 14 of board 11 with the elongated elements 12' and 12'' extending along the two opposite, longest sides of board 11 and the smaller elements 12 and 12''' positioned adjacent the opposite, shortest sides of board 11. The hook fabric swatches 13 on the bases of the guide elements are placed in contacting engagement with the pile fabric 21 affixed to the perimeter of the front surface 14 of board 11. The area of strike zone 16 may be adjusted as desired by simply moving each individual guide element on fabric 21. For example, strike zone 16 may be made small by moving the guide elements inwardly toward the center of strike zone 16 as seen in FIG. 2, or larger by moving the guide elements outwardly with the side surfaces of the guide elements having the hook fabric 13 being placed in contacting engagement with the pile fabric 21 on side walls 20 as seen in FIG. 3. This adjustability feature permits the trainee to practice his/her kicking and punching technique at varying difficulty levels with the difficulty of executing a kick or punch in the center of strike zone 16 being more difficult the smaller zone 16 is made.

As described previously, cooperatively engaging VELCRO® fabrics are used to removably attach the guide elements to board 11. The well-known adhesion characteristics of VELCRO® permit the easy separation of guide elements 12, 12', 12'' and 12''' from board 11 upon them being impacted in the slightest by a blow from a hand or foot. Thus, should the trainee fail to execute a straight kick or punch in the center of strike zone 16, a guide element will likely be impacted and detach from board 11 giving immediate visual indication to the trainee that the kick or punch was incorrect in form. Although the present invention preferably employs VELCRO® to removably attach the guide elements to board 11, other means are envisioned such as snap fasteners, hooks, clasps or the like.

Since the guide elements are formed from the same resilient foam rubber as board 11, they are light-weight thereby greatly reducing the chance of injury to a trainee. They are also virtually indestructible giving the invention a useful, long life.

Figure 4:
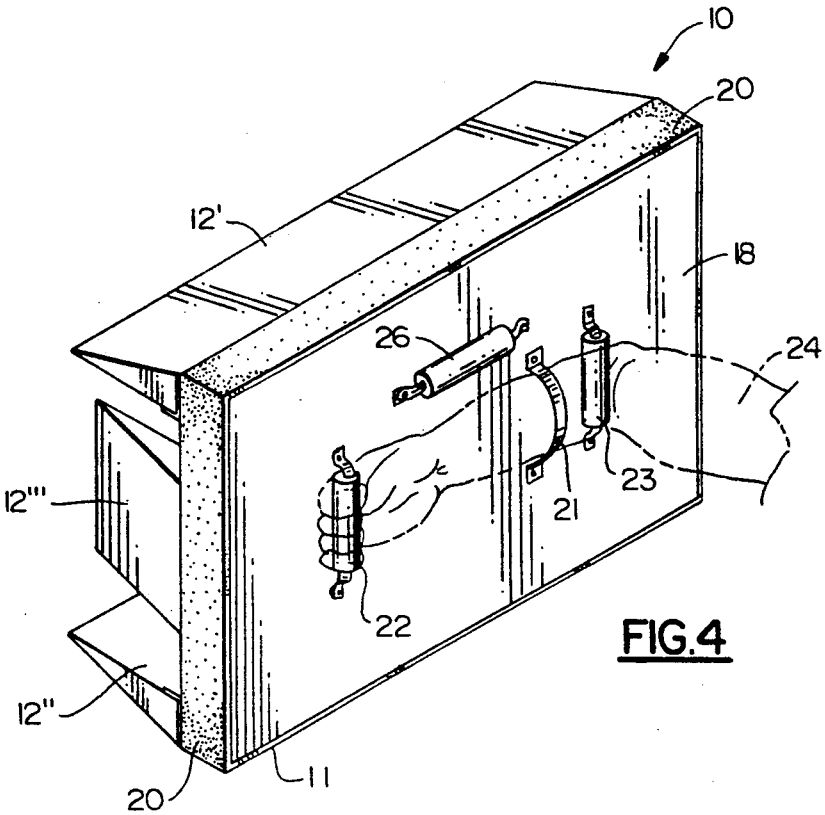
FIG. 4 is a rear perspective view of the embodiment of FIGS. 1–3 showing an arm in dotted outline grasping handles on the back of the device in the intended manner for striking by a second person (now shown)

Referring to FIG. 4, the rear surface 18 of board 11 is seen to include first, second and third, laterally spaced handles 21, 22, 23, respectively, through which a person's arm 24 may pass to hold the board 11 in an upright position in the manner shown. A fourth handle 26 is positioned above and extends perpendicularly with respect to handles 21, 22 and 23, handle 26 being provided to grasp with the person's other hand (now shown) for further stability. A partner to the trainee may thus hold board 11 with the front surface 14 facing toward the trainee. Training in this manner is very effective in that the partner can move focus box 10 around to force the trainee to approach a moving target, thus more realistically simulating "real-life" competition.

Figure 5:
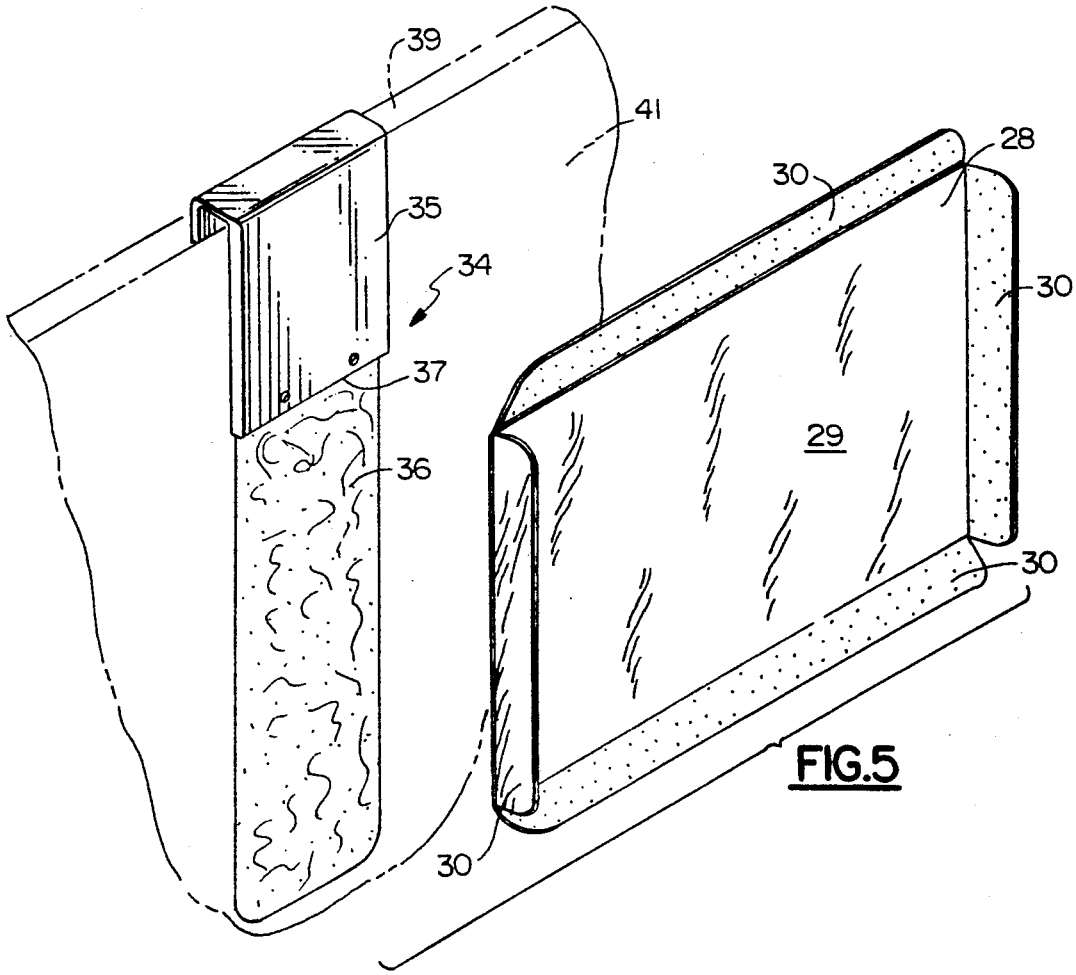
FIG. 5 is a perspective view of accessories for securing the training device shown in FIGS. 1–4 to a door.
Figure 6:
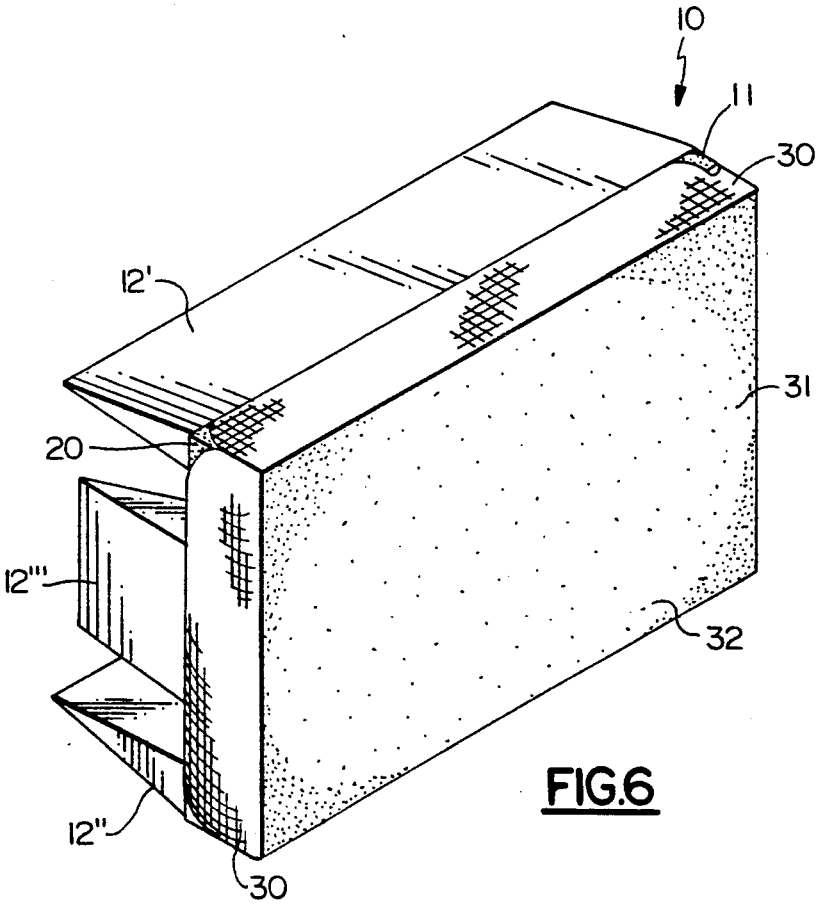
FIG. 6 is a rear perspective view of the invention showing the covering of FIG. 5 attached to the back surface thereof.

If training alone, means are provided for supporting focus box 10 in a stable, upright fashion. In a second embodiment, seen in FIGS. 5 and 6, a covering wrapper 28 having height and length dimensions substantially the same as the corresponding height and length dimensions of back surface 18 of strike board 11 including integral side flaps 30 is provided. Side flaps 30 are provided with VELCRO® hook fabric on the inner surfaces thereof (FIG. 5) for attaching to VELCRO® fabric 21 on sidewalls 20. Wrapper 28 may thus be removably connected in complete covering relation to back surface 18 with flaps 30 attaching to sidewalls 20. The back surface 32 of wrapper 28 opposite the surface 29 contacting surface 18 of board 11 is provided with VELCRO® fabric as seen in FIG. 6. A door hanger 34 is provided which includes a rigid, U-shaped bracket 35 including an elongated VELCRO® strip 36 fixedly attached to and extending downwardly from one straight edge 37 thereof. Bracket 35 may be removably mounted upon the top edge 39 of a door 41 with VELCRO® fabric strip 36 hanging freely therefrom against door 41 as seen in FIG. 5. The VELCRO® back surface 32 of wrapper 28 (which is attached to board 11 as seen in FIG. 6), may be removably attached to strip 36 with the front surface 14 of board 11 including elements 12 facing the trainee. In this way, the trainee may practice their kicking and punching techniques alone, without the aid of a second person.

Figure 7:
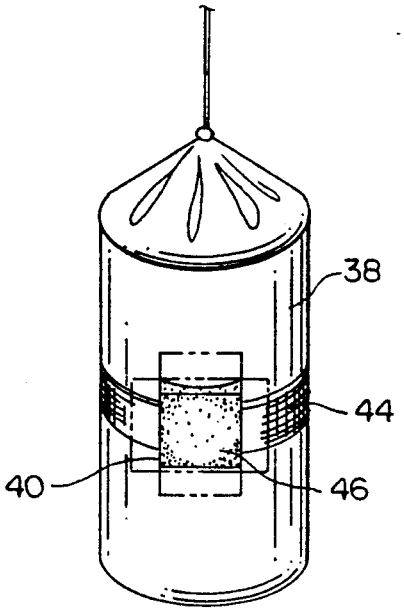
FIG. 7 is a perspective view of another accessory attached to a striking bag for securing the training device to the striking bag.
Figure 8:
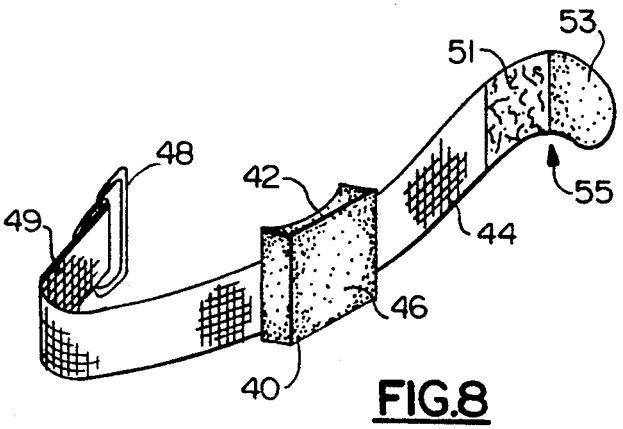
FIG. 8 is a perspective view of the accessory of FIG. 7 shown detached from the striking bag.

Referring to FIGS. 7 and 8, focus box 10 including wrapper 28 may also be removably mounted to a hanging punching bag 38. A rigid block 40 includes concave rear surface 42 which contours to the surface of punching bag 38. Block 40 is fixedly attached to a middle portion of belt 44 which is of a length to entirely wrap around bag 38 as seen in FIG. 7. The planar front surface 46 of box 40 includes a VELCRO® fabric covering whereby rear surface 32 of wrapper 28 may be removably attached thereto. Belt 44 is provided with a buckle 48 on a first end 49 thereof, and adjacent Velcro® hook and pile patches, respectively, for removably securing belt 44 around bag 38. Belt 44 is brought around bag 38, through buckle 48, and end 55 is doubled back on itself to engage pieces 51 and 53 together to form a tight fit around bag 38. Focus box 10, having wrapper 28 removably secured thereon, may then be removably attached to box 40 on bag 38. Focus box 10 may be positioned in any desired orientation on box 40 without losing any stability. This provides a somewhat mobile target as bag 38, and thus focus box 10, will start swinging after the trainee's initial strike.

Focus box 10 is shown in the drawing figures as having a rectangularly shaped striking board 11, and wedge shaped guide elements 12. Although these are the preferred shapes for these articles, any logical shape will suffice, and therefore the invention should not be limited to the shapes shown. Also, it is contemplated that guide elements 12–12''' may be fixedly mounted to strike board 11 if desired, with contact of a guide element with a foot or hand indicating improper technique to the trainee.

What is claimed is:

1. Apparatus for practicing martial arts kicking and punching technique comprising:

a) a strike board of predetermined outline having front and rear, opposite surfaces with said front surface being substantially planar and against which said kick and punch is directed;

b) at least one strike guide element of predetermined configuration adapted to outline a strike zone of predetermined area on said strike board front surface; and c) means removably attaching said at least one strike guide element to said strike board, said attachment means releasing said at least one guide element from said strike board upon impact by said kick or punch.

2. The invention according to claim 1 wherein said attachment means comprises cooperating hook and pile fabric affixed to said at least one strike guide element and said strike board, respectively.

3. The invention according to claim 2 and further comprising a plurality of strike guide elements removably arranged on said strike board and outlining said strike zone at substantially the center of said strike board front surface.

4. The invention according to claim 3 wherein said plurality of strike guide elements are individually movable on said strike board to provide selectively variable said strike zone areas of varying sizes and outlines on said strike board front surface.

5. The invention according to claim 4 wherein said strike board is substantially rectangular and includes four side edges extending perpendicularly between said front and rear surfaces.

6. The invention according to claim 5 wherein said pile fabric is affixed to said four side edges and at least a perimeter portion of said strike board front surface.

7. The invention according to claim 6 wherein four said strike guide elements are provided with each being wedge-shaped including a planar base surface and first and second, opposite side walls tapering inwardly away therefrom and terminating at an apex edge.

8. The invention according to claim 7 wherein said hook fabric is affixed to said planar base surfaces and a portion of one of said first and second side walls adjacent the respective said planar base of each of said four strike guide elements, said hook fabric on said side wall portion being removably attachable to said pile fabric on said strike board side walls with said apex edge spaced forwardly of said strike board front surface whereby said strike zone area is at a maximum size.

9. The invention according to claim 8 wherein two of said four strike guide elements are elongated and have widths substantially equal to the length of said strike board, and wherein the other two of said four strike guide elements have widths approximately half the height of said strike board.

10. The invention according to claim 9 wherein said elongated strike guide elements are removably positioned adjacent the two longest edges of said rectangular strike board and said other two strike guide elements are removably positioned adjacent the two shortest edges of said rectangular strike board.

11. The invention according to claim 10 wherein said base surfaces of said four strike guide elements are in contacting engagement with said pile fabric on said perimeter of said strike board front surface with said apex edges spaced forwardly of said strike board front surface.

12. The invention according to claim 11 and further comprising handle means mounted to said strike board rear surface adapted to be manually grasped by a person for supporting and presenting said strike board front surface to a martial arts trainee.

13. The invention according to claim 12 wherein said handle means comprises three laterally spaced loop handles and a fourth loop handle oriented perpendicularly and to one side of said three handles.

14. The invention according to claim 11 and further comprising a rectangular flexible fabric wrapper including hook fabric on perimeter portions of a first surface thereof, said hook fabric portions removably engaging said pile fabric on said strike board side edges with said wrapper lying in complete, covering relation to said strike board rear surface, a second surface of said wrapper opposite said first surface and facing away from said strike board rear surface including pile fabric affixed in covering relation to substantially all of said wrapper second surface.

15. The invention according to claim 14 and further including a door attachment for releasably securing said apparatus to a door, said door attachment comprising a U-shaped bracket adapted to removably mount to the top edge of said door, and an elongated hook fabric swatch of material attached to an edge of said bracket and hanging freely downwardly therefrom when said bracket is mounted to said door top edge, said pile fabric on said wrapper second surface being releasably attachable to said elongated hook fabric swatch and maintaining said strike board vertically oriented against said door.

16. The invention according to claim 14 and further including a punching bag attachment for releasably securing said apparatus to a punching bag, said punching bag attachment comprising:

a) an elongated belt having first and second ends adapted to encircle said punching bag with said first and second ends releasably secured together; and b) a mounting block attached to said belt including a hook fabric covering affixed thereto, said pile fabric on said holding said strike board in vertical orientation.

17. The invention according to claim 16 wherein said mounting block includes a concave rear surface against which said punching bag is positioned in cooperatively contoured contacting engagement.

* * * * *